US008544559B2

(12) United States Patent
Friberg et al.

(10) Patent No.: US 8,544,559 B2
(45) Date of Patent: Oct. 1, 2013

(54) PORTABLE POWER TOOL WITH INDICATING MEANS FOR ACTUAL OPERATION PARAMETER VALUES

(75) Inventors: John Robert Christian Friberg, Nacka (SE); Anders Urban Nelson, Älvsjö (SE)

(73) Assignee: Atlas Copco Industrial Technique Aktiebolag, Stockholm (SE)

( * ) Notice: Subject to any disclaimer, the term of this patent is extended or adjusted under 35 U.S.C. 154(b) by 314 days.

(21) Appl. No.: 12/867,323

(22) PCT Filed: Feb. 12, 2009

(86) PCT No.: PCT/SE2009/000081

§ 371 (c)(1),
(2), (4) Date: Sep. 7, 2010

(87) PCT Pub. No.: WO2009/102257

PCT Pub. Date: Aug. 20, 2009

(65) Prior Publication Data

US 2011/0005787 A1 Jan. 13, 2011

(30) Foreign Application Priority Data

Feb. 15, 2008 (SE) ..... 0800342

(51) Int. Cl.
*B25F 5/00* (2006.01)

(52) U.S. Cl.
USPC ..... 173/20; 173/2; 173/5; 173/6; 173/176; 173/177; 173/179; 173/218

(58) Field of Classification Search
USPC ..... 173/2, 5–6, 176, 177, 179, 218
See application file for complete search history.

(56) References Cited

U.S. PATENT DOCUMENTS

| | | | | |
|---|---|---|---|---|
| 2,925,089 | A | 2/1960 | Conklin et al. | |
| 3,587,752 | A | 6/1971 | Smith | |
| 4,908,604 | A * | 3/1990 | Jacob | 340/539.16 |
| 2004/0144552 | A1 | 7/2004 | Suzuki et al. | |
| 2006/0045751 | A1 * | 3/2006 | Beckman et al. | 417/44.2 |
| 2006/0055526 | A1 * | 3/2006 | Long | 340/502 |
| 2007/0103102 | A1 * | 5/2007 | Friberg | 318/254 |

FOREIGN PATENT DOCUMENTS

| | | |
|---|---|---|
| GB | 545651 | 6/1942 |
| GB | 2068150 A | 8/1981 |
| GB | 2068152 A | 8/1981 |

OTHER PUBLICATIONS

International Search Report dated May 13, 2009 issued in International Appln. No. PCT/SE2009/000081.

* cited by examiner

*Primary Examiner* — Michelle Lopez
(74) *Attorney, Agent, or Firm* — Holtz, Holtz, Goodman & Chick, PC

(57) ABSTRACT

A portable power tool having a housing with a rotation motor for powering a working implement, wherein sensors are provided to indicate the motor speed and the power supply, and a programmable evaluation unit is arranged to compare indicated speed and pressure values with stored limit values, and to accumulate the total operation time of the power tool and compare that with preset time limits for tool service intervals, and an optical information unit is provided on the housing to indicate whether those stored limit values have been reached.

9 Claims, 2 Drawing Sheets

PORTABLE POWER TOOL WITH INDICATING MEANS FOR ACTUAL OPERATION PARAMETER VALUES

This application is a U.S. National Phase Application under 35 USC 371 of International Application PCT/SE2009/000081 filed Feb. 12, 2009.

The invention relates to a portable power tool provided with indicating means for obtaining information of actual operation parameter values. In particular the invention concerns a portable power tool including a rotation motor, for instance a grinder.

In power tools of the above type there is a problem for the operator to be sure that the tool is operating with acceptable operation parameter values, i.e. correct speed, correct power supply. This creates an uncertainty relating both to the operator safety and the power tool safety and efficiency. If for instance a grinding tool is operated at too a high rotation speed there may be a risk for explosion of the grinding disc, and oppositely if the tool is operated at too a low speed the working operation would be inefficient. A too low a speed would also cause an excessive wear of the grinding wheel. If in for instance pneumatically powered grinders the supplied air pressure is too high there may be a risk of power tool damage, but a too low air pressure on the other hand would cause a poor tool efficiency due to a low power output and a resulting decreasing speed at work load. A further power tool safety aspect is the status or condition of the tool in respect of acceptable operating time intervals between status checks and/or regular overhaul operations.

There is also a cost aspect of the operating time indication, because if the power tool is used for an accumulated time that exceeds predetermined service intervals there is an increased risk for power tool breakdown and a following costly production disturbances and tool rebuild. Accordingly, it is important to optimize the service intervals of the power tool by indicating to the operator that the predetermined accumulated operation time of the power tool is reached.

It is an object to increase safety and ensure a high efficiency of a portable power tool by providing status indicating means referring to predetermined limit values for one or more tool operation and/or tool condition parameters.

It is another object of the invention to ensure a good safety and efficiency of a pneumatic power tool by monitoring the power supply.

It is a further object of the invention to optimize the service intervals of a power tool, thereby reducing cost of operation by preventing production disturbances and breakdowns of the power tool.

A preferred embodiment of the invention is described below in detail with reference to the accompanying drawing.

In the drawing

Figure 1:
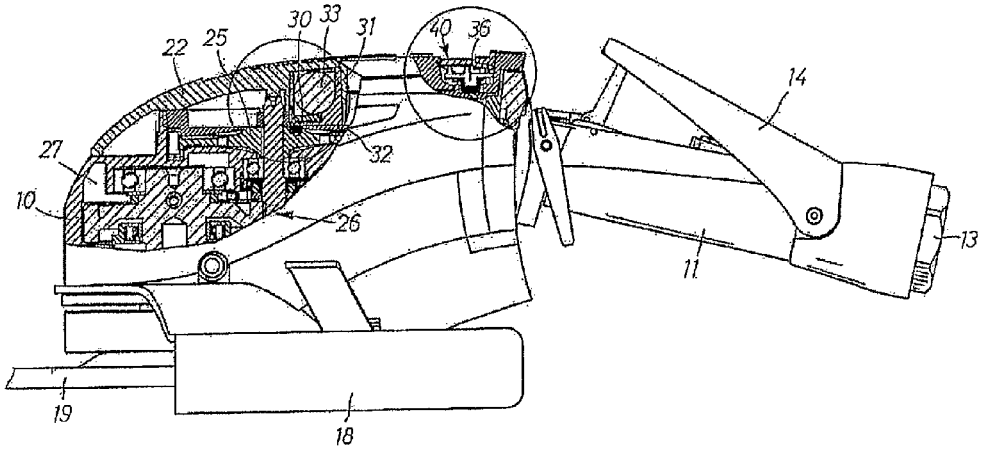
FIG. 1 shows a side view partly in section of a power tool according to the invention.
Figure 3:
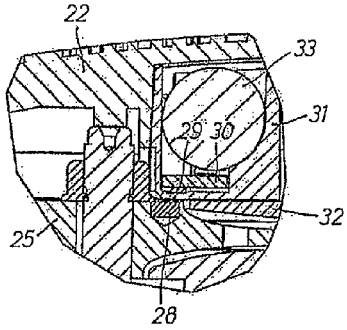
FIG. 3 shows on a larger scale a section through the battery and speed detecting device of the power tool in FIG. 1.
Figure 4:
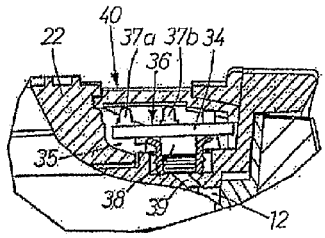
FIG. 4 shows on a larger scale and partly in section a side view of the electronic evaluation unit of the power tool in FIG. 1.
Figure 2:
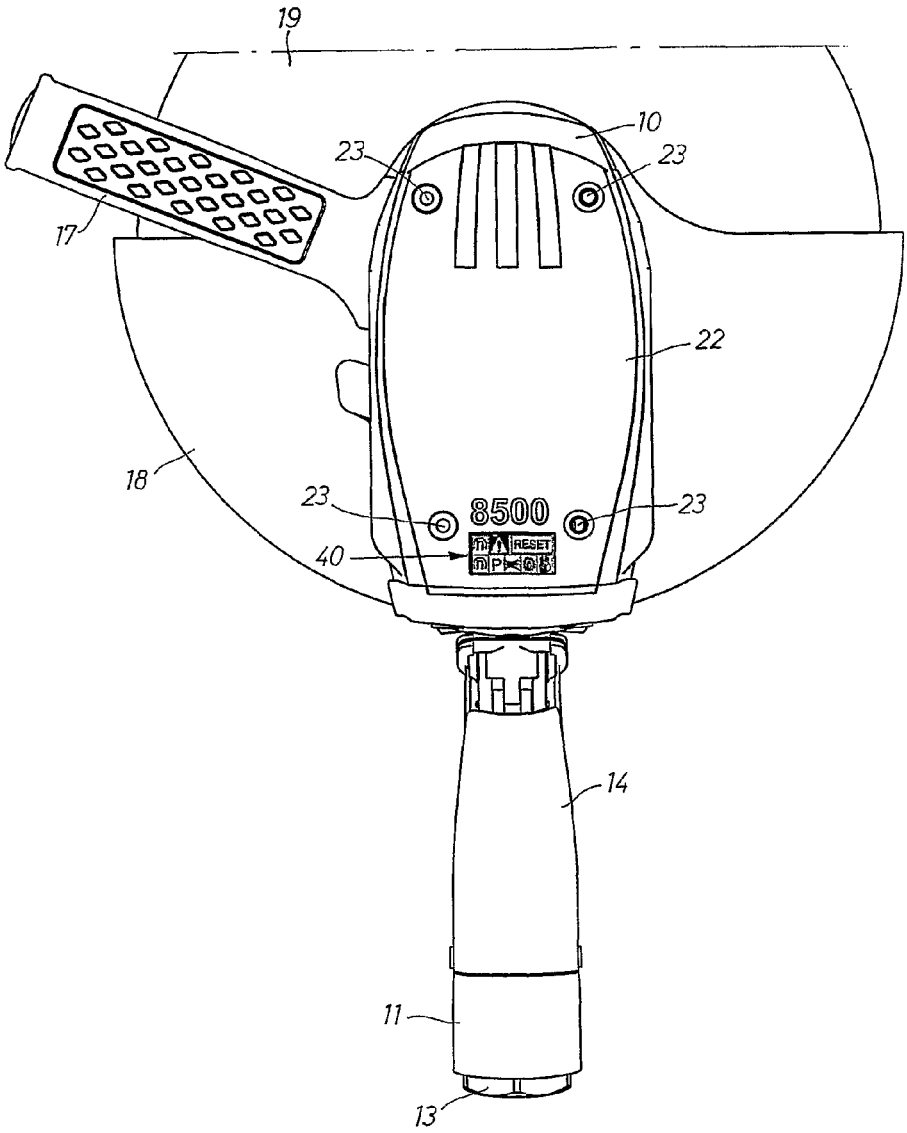
FIG. 2 shows a top view of the power tool in FIG. 1.

The power tool illustrated in the drawings is a portable pneumatic grinder which comprises a housing 10 with a rear handle 11 formed as a pressure air supply passage 12. At its rear end the handle 11 is provided with a connection socket 13 for a pressure air conduit and includes an air throttle valve operated by a lever 14. The housing 10 also carries a support handle 17 and a safety guard 18 partly surrounding a grinding wheel 19 attached to a non-illustrated output shaft of the tool. The housing 10 also includes a top cover 22 attached to the main part of the housing 10 by four screws 23.

The power tool also includes a rotation motor in the form of a one-stage turbine including a turbine wheel 25, and an oil lubricated reduction gearing 26. The very fast turbine wheel speed has to be reduced to safely power a normal grinding wheel, and the lubrication and cooling problem of this high speed gearing 26 require oil for lubrication instead of grease. The gearing 26 is enclosed in a sealed-off compartment 27 which is filled with a certain amount of oil at assembly or at regular service occasions. It is of great importance for the service life of the gearing 26 that a certain minimum amount of oil is maintained in the gearing compartment 27.

The power tool is provided with motor speed sensor in the form of a magnet 28 mounted on the turbine wheel 25 and a Hall sensor 29 carried on a circuit board 30. The latter is attached to a box 31 which is firmly secured between the top cover 22 and partition wall 32 in the housing 10 and which comprises a battery 33. The speed sensor Hall sensor 29 communicates with a printed circuit board 34 which is mounted in a recess 35 in the top cover 22 and carries a number of electronic components forming a programmable evaluation unit 36. The circuit board 34 also carries a number of LED elements 37*a,b* for optical indication of certain operation conditions and power tool status information determined by the evaluation unit 36. Moreover, the circuit board 34 carries a pressure sensor 38 which via passage 39 communicates with the pressure air supply passage 12 to indicate the actual feed pressure to the turbine wheel 25.

The evaluation unit 36 is arranged to be programmed with a high limit value for tool operation speed, an air pressure low limit value, time limits for the total accumulated power tool operation and for the tool operation time between check points for the oil level in the gearing compartment 27. The speed sensor Hall sensor 29 as well as the evaluation unit 36 including the pressure sensor 38 and the LED elements 37 are powered by the battery 33.

Figure 5:
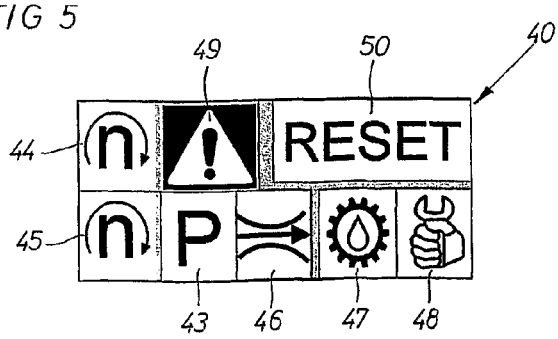
FIG. 5 shows on a larger scale the display of the power tool FIGS. 1 and 2.

On the top cover 22 there is arranged an information display 40 having a number of windows to be individually lit up by the LED elements 37*a,b* to provide optical information to the operator about different operation conditions and the actual tool status. Although only two LED elements 37*a,b* are disclosed in the drawings there are in fact a number of them for individual enlightening of the display windows. As illustrated in FIG. 5 these display windows comprise a "normal speed" window 44 indicating that the motor speed is within the set limit value and the power tool is in perfect order, an "augmented speed" window 45 indicating that the motor speed exceeds the maximum limit value by just a small amount, and that it is still safe to operate the tool, a "low static air supply pressure" warning window 43 indicating that the pressure air source does not deliver an air pressure giving maximum power output of the tool, a "low dynamic air supply pressure" warning window 46 indicating that the air pressure is reduced under full power output of the tool, an "oil check" information window 47, a "service interval" information window 48, and warning window 49 indicating that the tool must not be used because of an unsafe motor overspeed. The display 40 also comprises a "reset" window 50 to be engaged by a separate magnetic reset key to reset the operating time warning functions of the evaluation unit 36.

Before taking the power tool into operation desired limit values of the air supply pressure, high speed limit, and operation time limits for tool service and lubrication oil checks. In order to save electric power (battery) the evaluation unit 36 and the LED elements 37*a,b* are activated at a certain signal only. This signal is obtained via the air pressure sensor 38 in such a way that a double opening sequence of the throttle valve will put the evaluation unit into operation. This activation is programmed to last for a few seconds making it possible not only to observe the time limit and static air pressure limit windows but also to start the tool and check the high speed limit not being exceeded and the dynamic air supply pressure not being too low. The dynamic air pressure can only be detected during full power operation of the tool and indicates if there is a limitation of the air flow to the power tool resulting in a reduced power output of the tool. If only the "normal speed" window and no warning windows are lit up on the display 40 the tool is o.k. to put in operation.

When the windows 47 or 48 have indicated time limits for service and/or oil check and adequate measures have been taken to meet the maintenance requirements a magnetic reset key is applied against the "reset" window 50 and the evaluation unit is set to restart accumulating operation time to be compared with the programmed limit values.

By a power tool having sensing means and an evaluation unit with programmed limit values and an optical information display according to the invention it is made possible not only to improve power tool safety and working implement efficiency but to optimize service intervals and, thereby, the overall service life of the power tool.

The invention claimed is:

1. A pneumatic portable power tool comprising:

a housing with a handle;

a connection socket for connection of a pressure air supply conduit for supplying pressure air;

a pneumatic rotation motor for powering a working implement;

a speed sensor which indicates an actual motor speed value of the motor;

a pressure sensor which indicates an actual pressure value of the supplied pressure air;

a programmable electronic evaluation unit connected to said speed sensor and to said pressure sensor and which is arranged to compare the indicated actual motor speed value and the indicated actual pressure value with stored limit values for motor speed and air pressure; and optical elements provided on the housing and activated by said evaluation unit to inform an operator of the power tool if the actual indicated speed value and the actual indicated pressure value do or do not comply with said limit values.

2. The power tool according to claim 1, wherein:

said evaluation unit has stored therein a motor speed high limit and a motor speed low limit, and said evaluation unit is arranged to alternately activate a first optical element from among said optical elements indicating that the actual motor speed value is within a range defined by said high limit and said low limit, and a second optical element from among said optical elements indicating that the actual motor speed value exceeds said high limit.

3. The power tool according to claim 2, wherein:

said evaluation unit comprises a tool operation time accumulating unit, said evaluation unit is arranged to compare the accumulated tool operation time with a predetermined stored service time limit, and said power tool further comprises a time limit warning element arranged to be activated to indicate that said accumulated tool operation time has reached said service time limit.

4. The power tool according to claim 2, further comprising a resetting unit for resetting said evaluation unit, said resetting unit comprising a magnetic device arranged to be activated by a separate magnetic reset key.

5. The power tool according to claim 1, wherein:

said evaluation unit comprises a tool operation time accumulating unit which obtains an accumulated tool operation time, said evaluation unit is arranged to compare the accumulated tool operation time with a predetermined stored service time limit, and said power tool further comprises a time limit warning element arranged to be activated to indicate that said accumulated tool operation time has reached said service time limit.

6. The power tool according to claim 5, further comprising a resetting unit for resetting said evaluation unit, said resetting unit comprising a magnetic device arranged to be activated by a separate magnetic reset key.

7. The power tool according to claim 1, further comprising a resetting unit for resetting said evaluation unit, said resetting unit comprising a magnetic device arranged to be activated by a separate magnetic reset key.

8. The power tool according to claim 7, wherein:

said optical elements form parts of a display panel, and said display panel further comprises said magnetic device for co-operation with said magnetic reset key.

9. The power tool according to claim 8, wherein:

the housing comprises a detachable top cover, and said evaluation unit and said display panel are mounted on said top cover.

* * * * *